US010926320B2

(12) United States Patent
Vincent

(10) Patent No.: US 10,926,320 B2
(45) Date of Patent: Feb. 23, 2021

(54) TRANSITION PLATE

(71) Applicant: PYROTEK ENGINEERING MATERIALS LIMITED, Buckinghamshire (GB)

(72) Inventor: Mark Vincent, Bedfordshire (GB)

(73) Assignee: Pyrotek Engineering Materials Limited, Buckinghamshire (GB)

( * ) Notice: Subject to any disclaimer, the term of this patent is extended or adjusted under 35 U.S.C. 154(b) by 0 days.

(21) Appl. No.: 16/629,398

(22) PCT Filed: Aug. 23, 2018

(86) PCT No.: PCT/GB2018/052399
§ 371 (c)(1),
(2) Date: Jan. 8, 2020

(87) PCT Pub. No.: WO2019/038551
PCT Pub. Date: Feb. 28, 2019

(65) Prior Publication Data

US 2020/0139428 A1 May 7, 2020

(30) Foreign Application Priority Data

Aug. 24, 2017 (GB) ..... 1713593

(51) Int. Cl.
*B22D 11/049* (2006.01)
*B22D 11/04* (2006.01)

(52) U.S. Cl.
CPC ..... *B22D 11/049* (2013.01); *B22D 11/0403* (2013.01)

(58) Field of Classification Search
CPC ..... B22D 11/0401; B22D 11/0403; B22D 11/049
See application file for complete search history.

(56) References Cited

U.S. PATENT DOCUMENTS

| | | | | |
|---|---|---|---|---|
| 4,598,763 | A | 7/1986 | Wagstaff et al. | |
| 4,986,337 | A * | 1/1991 | Soulier | B22D 11/0401 164/420 |
| 5,873,405 | A | 2/1999 | Carrier et al. | |
| 2004/0206473 | A1* | 10/2004 | Sale | B22D 11/0401 164/488 |
| 2005/0061468 | A1 | 3/2005 | Schneider et al. | |
| 2005/0126745 | A1* | 6/2005 | Bowles | B22D 11/0401 164/490 |
| 2008/0041553 | A1* | 2/2008 | Snyder | B22D 11/0403 164/472 |

FOREIGN PATENT DOCUMENTS

| | | | |
|---|---|---|---|
| EP | 3033190 | B1 | 2/2018 |
| WO | 2015022507 | A2 | 2/2015 |

OTHER PUBLICATIONS

International Search Report for PCT Application No. PCT/GB2018/052399, dated Oct. 18, 2018, 12 pages.

* cited by examiner

*Primary Examiner* — Kevin E Yoon
(74) *Attorney, Agent, or Firm* — Fay Sharpe LLP

(57) ABSTRACT

A transition plate for use in a direct chill (DC) casting system comprises a substantially annular body having an upper face and a lower face. At least a lower part of the body adjacent the lower face is made of a gas permeable refractory material, whereby gas can pass through the gas permeable refractory material and escape from the transition plate through at least the lower face.

21 Claims, 9 Drawing Sheets

A-A

TRANSITION PLATE

The present invention relates to a transition plate for use in a direct chill (DC) casting system for casting non-ferrous metals. The invention also relates to a DC casting system and a method of operating a DC casting system.

DC casting is a vertical semi-continuous casting process used for the fabrication of cylindrical billets from non-ferrous metals such as aluminium and alloys thereof. A DC casting system is described for example in U.S. Pat. No. 4,598,763.

A DC casting system typically includes a plurality of water-cooled moulds, each having an open-ended vertical passageway through which the liquid metal flows. As the molten metal passes through the moulds it is cooled, causing the peripheral region of the metal to freeze. The metal is further cooled by water jets as it emerges from the lower end of the mould causing the remainder of the metal to freeze, thereby forming a cylindrical billet. The lower end of the billet is supported by a starting head (or dummy block), which is lowered gradually (typically at a rate of 50-150 mm/min) by a hydraulic ram. Liquid metal is supplied continuously to the mould until the hydraulic ram reaches its bottom position. Typically, billets produced by the DC process have a diameter of 50-500 mm with a length of 4-8 metres.

A DC casting system normally has a plurality of moulds, typically allowing 2-140 billets to be formed simultaneously. The moulds are supported by a steel casting table and are fed with molten metal through a metal distribution system. There are two principle designs of DC casting system: in the first design the flow of metal is controlled by a float and in the second design the metal flows into the mould through a feeding device made of a refractory material. This second design is often called a "hot-top" casting system.

In a typical hot-top casting system the metal distribution system includes a plurality of refractory feeding devices called "cross-feeders" that contain the liquid metal and distribute it to the moulds as the billets are formed. The cross-feeders are supported on a steel casting table and distribute the liquid metal to a plurality of casting sites beneath the table. Additional refractory components are provided beneath the table to guide the flow of liquid aluminium from the cross-feeder to the casting sites. These refractory components typically include a cylindrical sleeve (called a "thimble" or "scupper") that fits into the circular feed hole of the cross-feeder, a circular transition plate (also called a T-plate or "top ring") that extends radially outwards from the lower end of the thimble, and a tubular cylindrical graphite casting ring (or "casting mould") that extends downwards from the outer periphery of the transition plate. These components may for example be substantially as described in U.S. Pat. No. 4,598,763.

In a conventional DC casting system the refractory components may be made from different refractory materials, according to their individual requirements. For example, the thimble may be made from a cement-bonded fused silica refractory, and the transition plate may be made from a calcium silicate board material. Typically, in a conventional DC casting system, a thimble will operate for about 500 casts and the calcium silicate transition plate will operate for 250 to 350 casts.

The purposes of the transition plate are sealing the top of the mould to prevent liquid metal escaping, guiding the flow of liquid metal outwards from the thimble to the casting ring, and ensuring a smooth transition from a horizontal to a vertical flow direction when the metal reaches the casting ring. The transition plate comes into direct contact with the liquid metal, which is extremely aggressive and can cause severe erosion of the calcium silicate material from which the transition plate is made. The subsurface layers of the transition plate also suffer from chemical attack due to vapour ingress. The transition plate also experiences extreme thermal cycling, with the temperature cycling between about 70 C and 730 C every 2-3 hours when in service. This can lead to cracking, requiring replacement of the transition plate.

To protect the transition plate from erosion, it is normally given a protective coating, for example of boron nitride. This provides a protective surface and helps to prevent vapour ingress. However, the coating wears away during use and has to be frequently re-applied, in some cases after each casting operation. Re-applying the coating is a time-consuming and hazardous manual process, which adds to the cost of the casting process and gives rise to significant safety risks.

It is an object of the present invention to provide a transition plate that mitigates one or more of the aforesaid problems, or that provides advantages over existing transition plates. A further object of the present invention is to provide a DC casting system and a method of making a transition plate for use in a DC casting system.

According to one aspect of the invention there is provided a transition plate for use in a direct chill (DC) casting system, the transition plate comprising a substantially annular body having an upper face and a lower face, wherein at least a lower part of the body adjacent the lower face comprises a gas permeable refractory material, whereby gas can pass through the gas permeable refractory material and escape from the transition plate through the lower face.

The feature that at least a lower part of the body comprises a gas permeable refractory material implies that either the entire body is gas permeable or only a part of the body is gas permeable. For example, different parts of the body may have different levels of permeability, so that in use gas flows preferentially through the part or parts that have a relatively high gas permeability. A part with a relatively high gas permeability is located in a lower part of the body adjacent the lower face, to enable a flow of gas towards and through the lower face.

The gas permeable refractory material enables a gas, for example an inert gas, to permeate through the lower face, thereby forming a gas layer between the liquid metal and the lower face of the transition plate, which protects the transition plate from chemical attack from the liquid metal. The gas layer also prevents vapours from the liquid metal entering the transition plate. The need for a protective coating, for example of boron nitride, is thus eliminated or reduced. The disadvantages associated with the need for a protective coating, including inefficient operating practices and/or the hazards associated with applying the coating, are thus removed or reduced. More efficient and safer operation can thus be achieved.

Preferably, the gas permeable refractory material is porous. Porosity is measure of the amount of free space in the refractory material. In the present invention the aim is to provide an even but low level of porosity, so that gas flows slowly but evenly through the body of the transition plate and permeates evenly through the lower face of the transition plate. The gas permeable refractory material may for example have a porosity in the range 0.5% to 55%. In an embodiment, the gas permeable refractory material may have a porosity in the range 2-55%, more preferably 10-55%.

In an embodiment, the gas permeable refractory material has a density in the range 0.5-2.0 g/cm$^3$.

In an embodiment, at least a lower part of the body is made of a refractory ceramic material. Alternatively, a lower part of the body may be made from various other refractory materials including, for example, materials based on graphite or a mixture of graphite and ceramic materials.

In an embodiment, at least a lower part of the body is made from a castable ceramic material that is based silica and includes fused silica, ceramic fibre, microsilica and a bonding material, for example colloidal silica. This material is strong and has good resistance to erosion from liquid aluminium and aluminium alloys, good thermal shock resistance, low thermal conductivity and good dimensional stability. The three forms of silica (fused silica, microsilica and colloidal silica) contained within the ceramic material ensure a near ideal packing density, thereby increasing the strength of the transition plate.

The use of a castable ceramic material simplifies the production of transition plates. Optionally, the material can be machined, allowing transition plates to be made to very fine tolerances.

The use of ceramic fibre within the ceramic material helps to disperse thermal and mechanical stresses within the transition plate, thereby increasing the strength and thermal shock resistance of the product. The term "ceramic fibre" as used herein is intended to include both crystalline ceramic fibres and amorphous ceramic fibres (vitreous or glass fibres). The ceramic fibre may for example be an alkaline earth silicate fibre or an alumino silicate fibre.

The ceramic fibre may for example be a synthetic ceramic fibre, which is preferably stable up to a temperature of at least 1200 C. The ceramic fibre may be a non-RCF fibre, for example an alkaline earth silicate fibre. The ceramic fibre is preferably soluble (non-durable) in physiological fluids, for example lung fluid. This helps to reduce or avoid the health risks associated with the use of non-soluble fibres, which can cause lung disease if inhaled.

The ceramic material may include a dispersing agent, for example a polyacrylate.

The ceramic material may include a non-wetting agent, for example Barium Sulphate, Calcium Fluoride or Magnesium Fluoride. The non-wetting agent helps to protect the transition plate from attack by the molten aluminium.

Advantageously, the ceramic material has a density after firing in the range 0.5-2.0 g/cm$^3$, and may be classified as a low to medium density ceramic material. The ceramic material may include density modifiers, for example water or woolastonite, of perlite, or cenospheres, to achieve the required density.

In an embodiment, the transition plate comprises at least one chamber located within the body between the upper face and the lower face, and at least one gas duct connected to the chamber. At least a lower part of the body, located between the chamber and the lower face, may comprise a gas permeable refractory material. The provision of a chamber and a gas duct connected to the chamber allows gas to be supplied efficiently to the transition plate, so that it can permeate through the gas permeable lower part of the body and escape through the lower face of the plate.

In an embodiment, the chamber is located closer to the lower face than the upper face. Locating the chamber closer to the lower face than the upper face ensures that the gas flows preferentially through the lower face of transition plate, thus creating the required gas layer between the liquid metal and the lower face of the transition plate. In one embodiment the chamber is located 1-5 mm from the lower face.

In an embodiment, the chamber extends around substantially the entire circumference of the annular body, to ensure that the gas layer covers substantially the entire lower face of the transition plate. However, it is also possible to provide a chamber extends around slightly less than the entire circumference of the annular body, owing to the permeability of the refractory material.

The chamber may be substantially annular. Alternatively, it may have various other shapes, for example as described herein.

In an embodiment, the chamber extends radially over the majority of the radial width of the lower face, to ensure that the gas layer covers substantially the entire lower face of the transition plate. However, it is also possible to provide a chamber extends over less than the entire radial width of the annular body, owing to the permeability of the refractory material.

According to another aspect of the invention there is provided a direct chill (DC) casting system comprising a distribution device, a thimble, a transition plate and a casting ring, wherein the transition plate comprises a substantially annular body having an upper face and a lower face, and wherein at least a lower part of the body adjacent the lower face comprises a gas permeable refractory material, whereby gas can pass through the gas permeable refractory material and escape from the transition plate through at least the lower face.

In an embodiment, the DC casting system further comprises a gas supply connected to the transition plate, whereby the supplied gas can pass through the gas permeable refractory material and escape from the transition plate through at least the lower face.

In an embodiment, the transition plate comprises at least one chamber located within the body between the upper face and a lower face, and at least one gas duct connected to the chamber, wherein the gas supply is connected to the gas duct.

According to another aspect of the invention there is provided a method of operating a DC casting system comprising a distribution device, a thimble, a transition plate and a casting ring, wherein the transition plate comprises a substantially annular body having an upper face and a lower face, and wherein at least a lower part of the body adjacent the lower face is made of a gas permeable refractory material, the method comprising supplying liquid metal to the distribution device so that the liquid metal flows through the thimble and past the transition plate towards the casting ring, and feeding gas to the transition plate so that the gas passes through the gas permeable refractory material and escapes from the lower face of the transition plate to form a gas layer between the liquid metal and the lower face of the transition plate.

The gas may be an inert gas, for example nitrogen or argon.

The gas may for example be fed into the chamber at a flow rate in the range 5-30 litres/minute, preferably 10-20 litres/minute and/or at a gauge pressure in the range 0.1-2.0 bar, preferably 0.2-1.0 bar.

The transition plate may be made of a ceramic material based on fused silica, which may also include ceramic fibre, microsilica and a bonding agent. Alternatively, the transition plate may be made of graphite or a combination of ceramic and graphite that is formulated to provide the correct gas permeability.

Certain embodiments of the invention will now be described by way of example with reference to the accompanying drawings, wherein.

Figure 1:
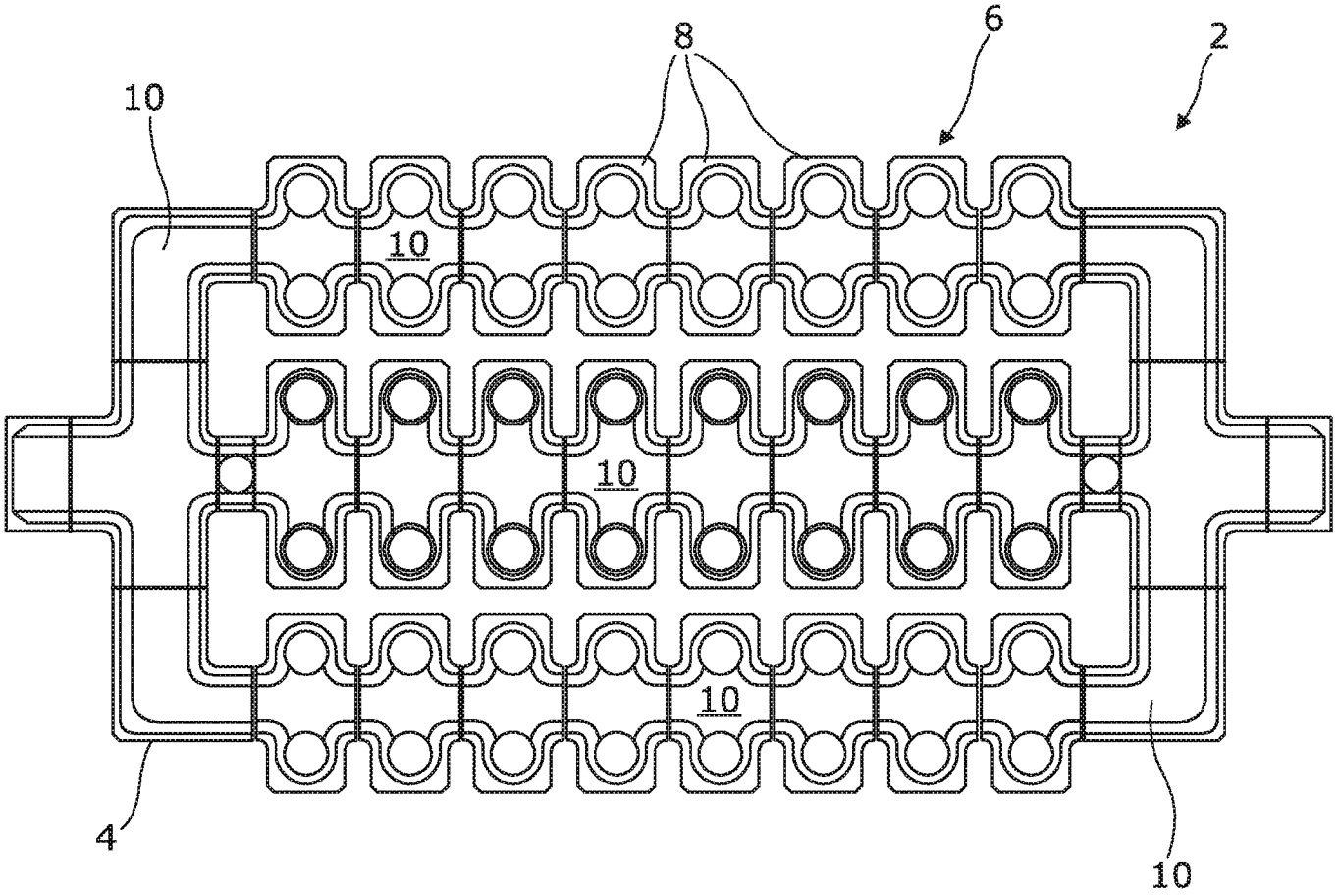
FIG. 1 is a plan view of a casting table for a DC casting system.
Figure 2:
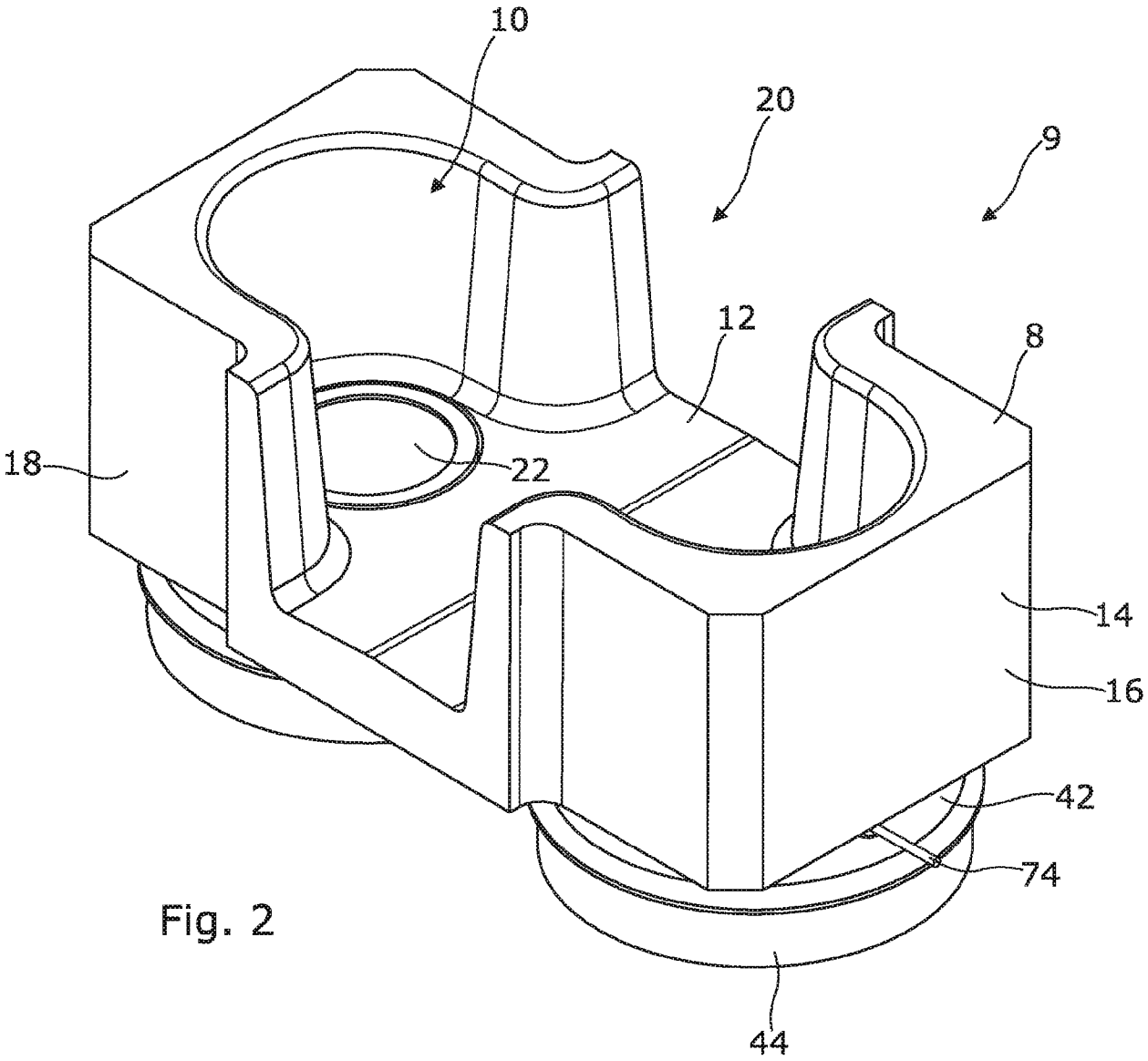
FIG. 2 is an isometric view of a metal casting assembly that forms part of a DC casting system.
Figure 3:
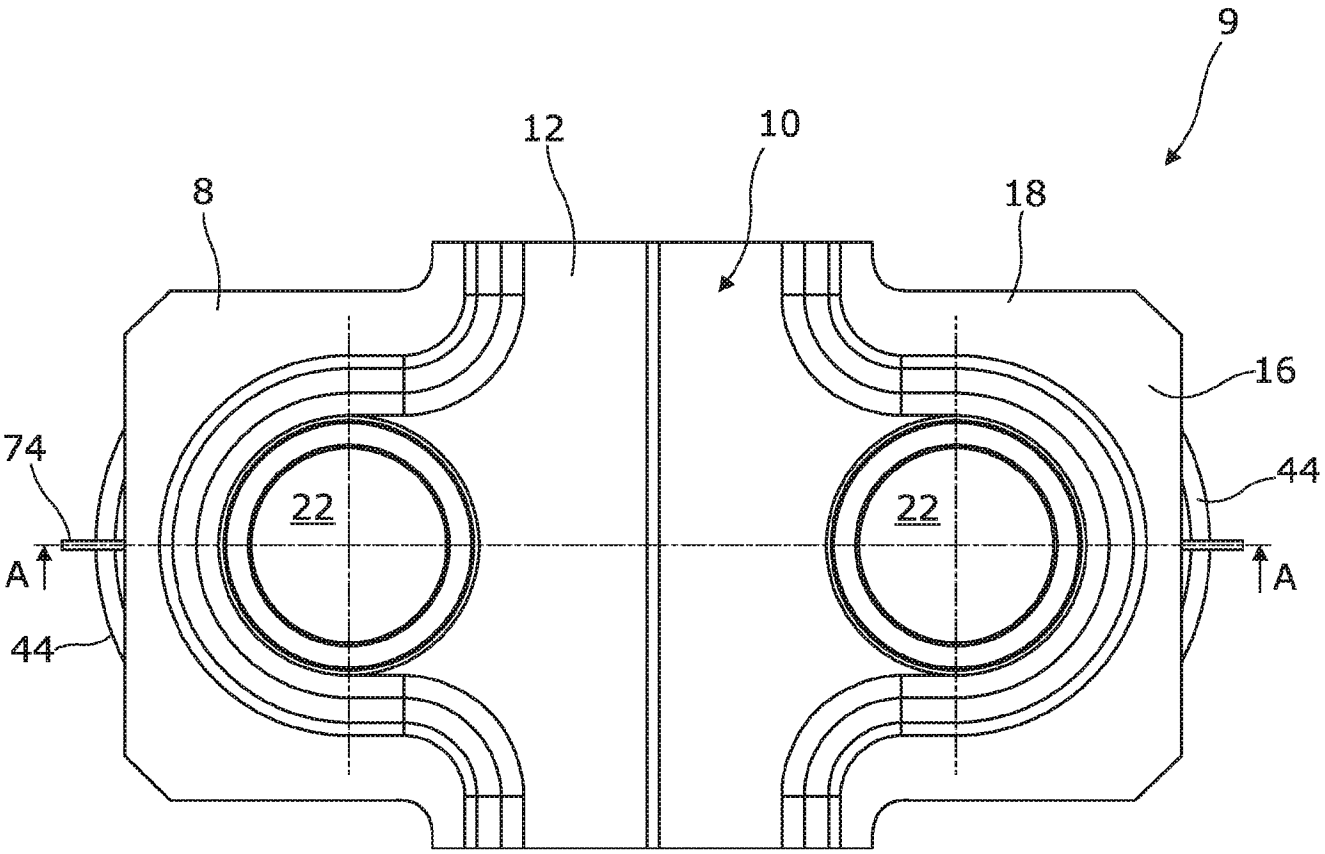
FIG. 3 is a plan view showing an upper side of the metal casting assembly.
Figure 4:
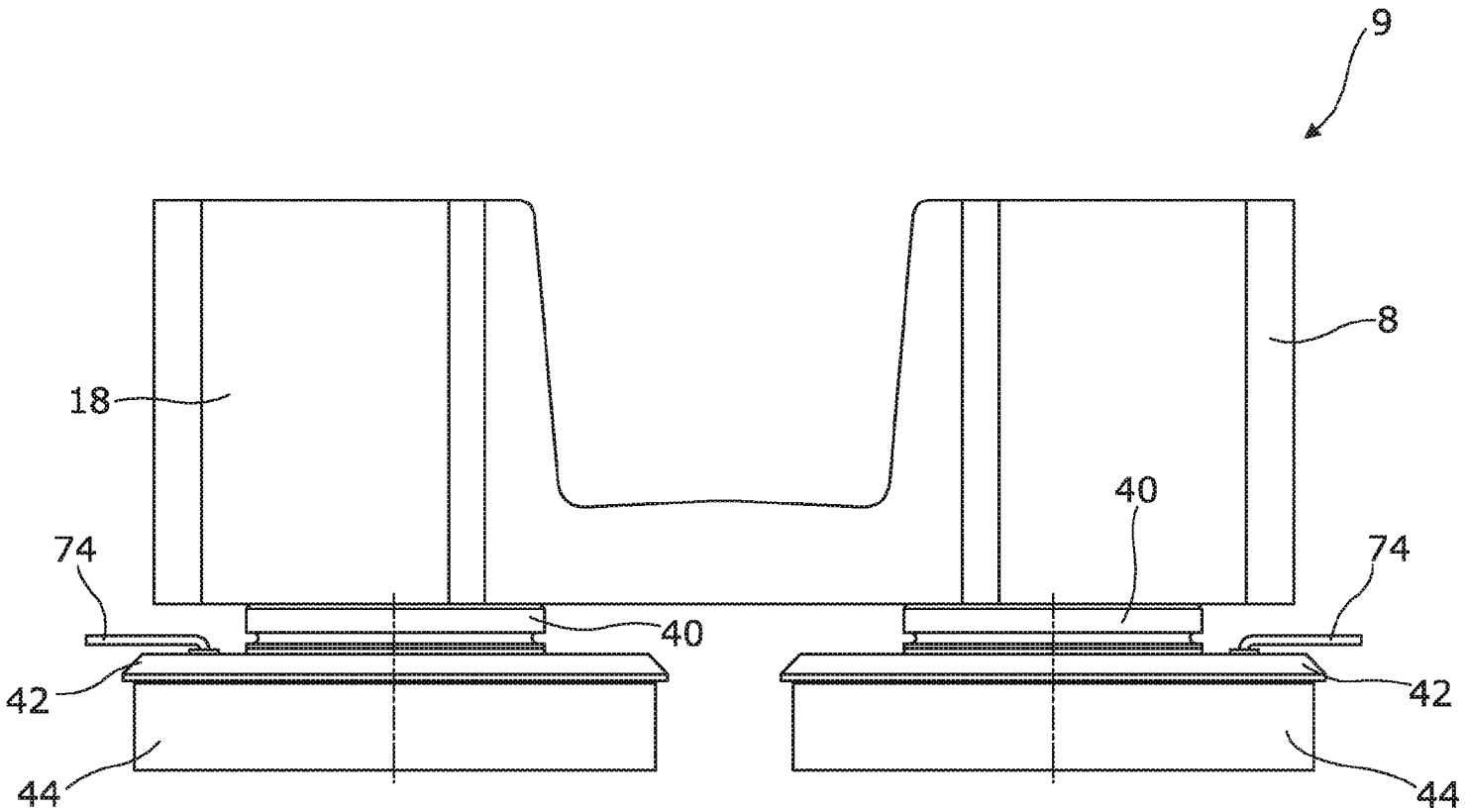
FIG. 4 is a side view of the metal casting assembly.

The casting table 2 shown in FIG. 1 comprises a rectangular steel support table 4 and a distributor system 6 comprising a plurality of refractory distribution devices 8 providing a trough 10 for containing and distributing liquid metal to a plurality of casting sites located beneath the support table 4. This particular casting table 2 is suitable for use in a direct chill (DC) casting system for fabricating cylindrical billets from non-ferrous metals such as aluminium and alloys thereof.

Each distribution device 8 comprises part of a metal casting assembly 9, an example of which is shown in FIGS. 2-5. The distribution device 8 may for example be made of a cast refractory ceramic material and include a base 12 and a peripheral wall 14, which together provide the open-topped trough 10. The peripheral wall 14 comprises two short end walls 16 and two longer side walls 18. A U-shaped channel 20 is formed in each side wall 18.

When a plurality of distribution devices 8 are mounted together on a support table 4 as shown in FIG. 1 the U-shaped channels 20 are aligned with one another forming the open-topped trough 10 that allows liquid metal to flow between the distribution devices 8.

Two circular feed holes 22 are provided in the base 12 of the distribution device 8. In use, liquid metal can flow through these holes 22 to the casting sites defined by the table 2, so as to form billets. In this example the distribution device 8 has two feed holes 22, but it may alternatively have more or fewer than two feed holes.

Each metal casting assembly 9 also includes a number of additional refractory components, which guide the flow of liquid aluminium from the distribution device 8 during formation of a billet. These refractory components include a cylindrical sleeve (also called a "thimble" or "scupper") 40 that fits within the circular feed hole 22 and extends through the support table 4, a transition plate (or "T-plate" or "top ring") 42 that extends radially outwards from the lower end of the thimble 40, and a tubular graphite casting ring (or "casting mould") 44 that extends downwards from the outer periphery of the transition plate 42. A gasket may be provided within the cylindrical joint 46 between the thimble 40 and the transition plate 42 to prevent liquid metal leaking through the joint.

Figure 9:
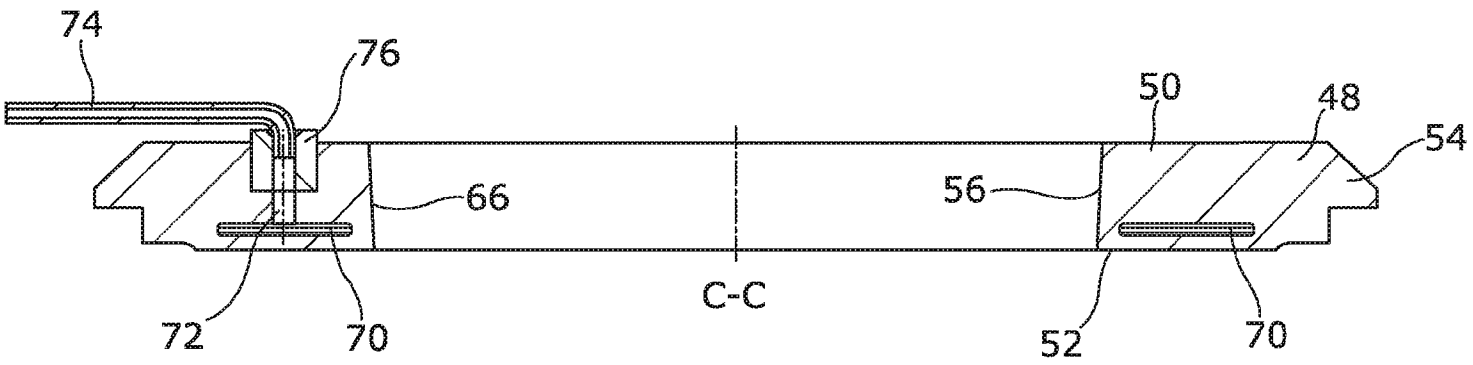
FIG. 9 is a sectional side view of the transition plate, taken on line C-C of FIG. 7.

The transition plate 42, which is shown in more detail in FIGS. 6 to 9, comprises an annular body 48 having an upper face 50, a lower face 52, an outer perimeter 54 and an inner perimeter 56. The outer perimeter 54 comprises a bevelled upper part 58 and a cylindrical lower part 60, which is smaller in diameter than the upper part 58, thus forming a step 62 between the upper part 58 and the lower part 60. The lower face 52 includes a shallow annular recess 64 that extends around the periphery of the lower face 52. The inner perimeter 56 tapers inwards from top to bottom, as shown in FIG. 9, providing a frusto-conical inner face 66.

As shown in FIG. 9, the transition plate 42 contains a chamber 70 that extends around the annular body 48 of the transition plate 42, and is located between the upper face 50 and the lower face 52, and between the outer perimeter 54 and the inner perimeter 56. The chamber 70 is connected via a gas supply duct 72, which in this embodiment extends upwards to the upper face 50 of the transition plate 42. A gas supply pipe 74 is connected to the duct 72 via an inlet connection 76, allowing pressurised gas to be supplied to the chamber 70.

In this embodiment, the chamber 70 is annular and extends around the entire circumference of the annular body 48. Alternatively, the chamber 70 may have a different shape: for example, it may extend around less than the entire circumference of the annular body 48, it may be spiral-shaped or consist of a set of concentric rings, or it may include a circular duct and a number of branches that extend outwards and/or inwards from the duct. Also, instead of a single chamber 70, two or more chambers may be provided, each having a separate gas supply duct 72.

The chamber 70 preferably has a radial width that is only slightly less than the radial width of the lower face 52, so that gas passes through the majority of the area of the lower face 52. Alternatively, the chamber 70 may be located closer to the inner perimeter 56 than the outer perimeter 54 and may have a radial width less than the radial width of the lower face 52: in this case gas can be transported radially outwards over the lower face 52 by the flow of liquid metal, forming a continuous layer.

In an embodiment the chamber 70 is located close to the lower face 52 of the transition plate 42: for example, it may be positioned within 1-5 mm from the lower face 52, or at a greater or smaller distance. Generally, the chamber 70 will be located closer to the lower face 52 than to the upper face 50 or the outer or inner perimeters 54, 56.

The transition plate 42 is made at least partially of a permeable refractory material, so that when gas is supplied under pressure to the chamber 70 through the duct 72, the gas can flow through the permeable material to at least the lower face 52, and then escape from the transition plate 42 through at least the lower face 52. The required permeability may be provided by use of a porous material with a suitable level of porosity.

If the transition plate 42 is made of a homogeneous permeable material, locating the chamber 70 closer to the lower face 52 than the upper face 50 will ensure that gas flows preferentially towards the lower face 52 and then permeates from the transition plate through the lower face 52. The chamber 70 may for example be located about 1-5 mm from the lower face 52.

Figure 5:
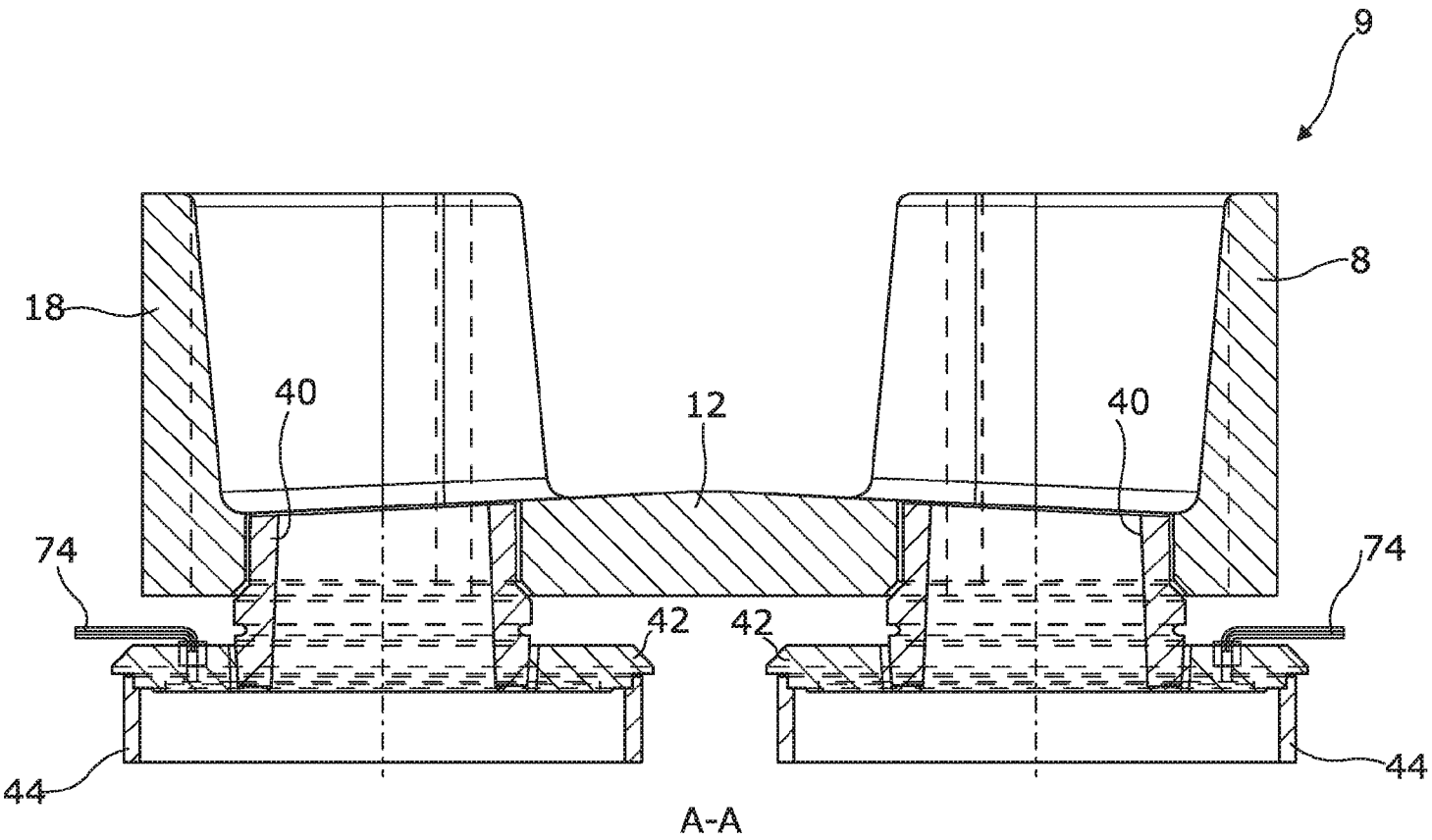
FIG. 5 is a sectional side view of the metal casting assembly, taken on line A-A of FIG. 3.
Figure 6:
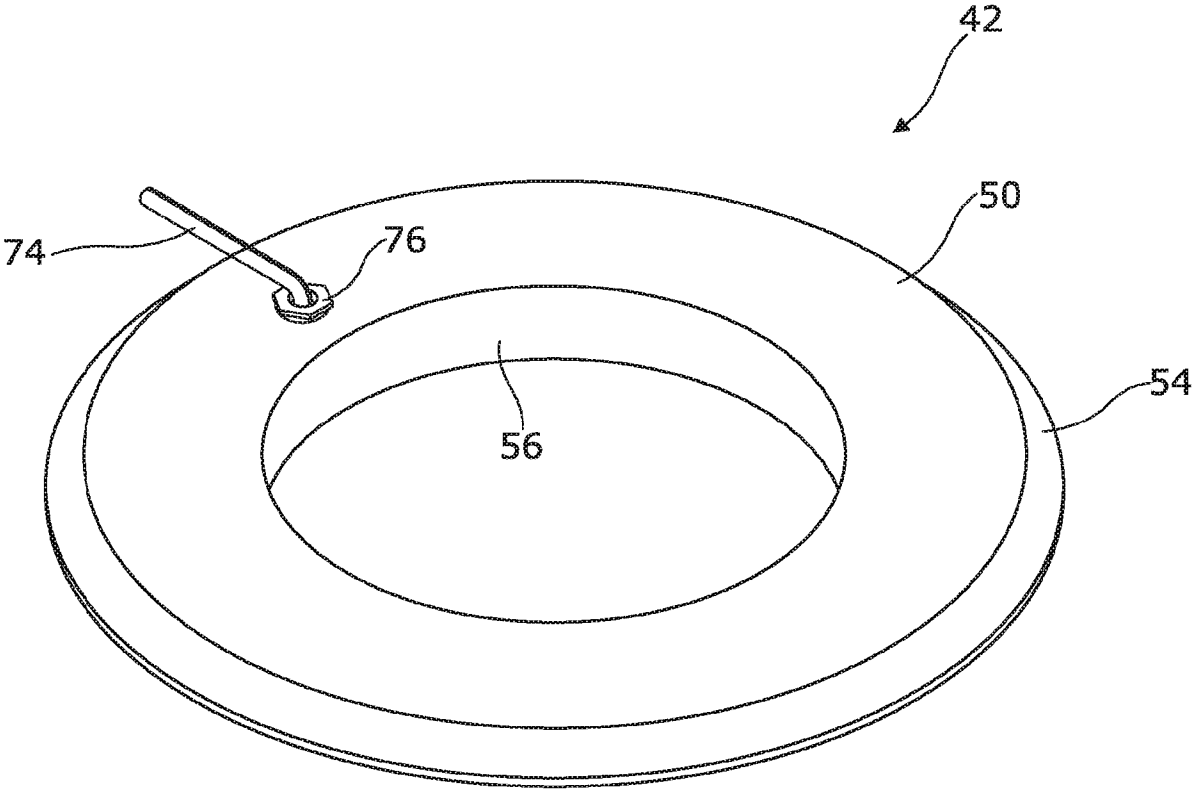
FIG. 6 is an isometric view of a transition plate.
Figure 7:
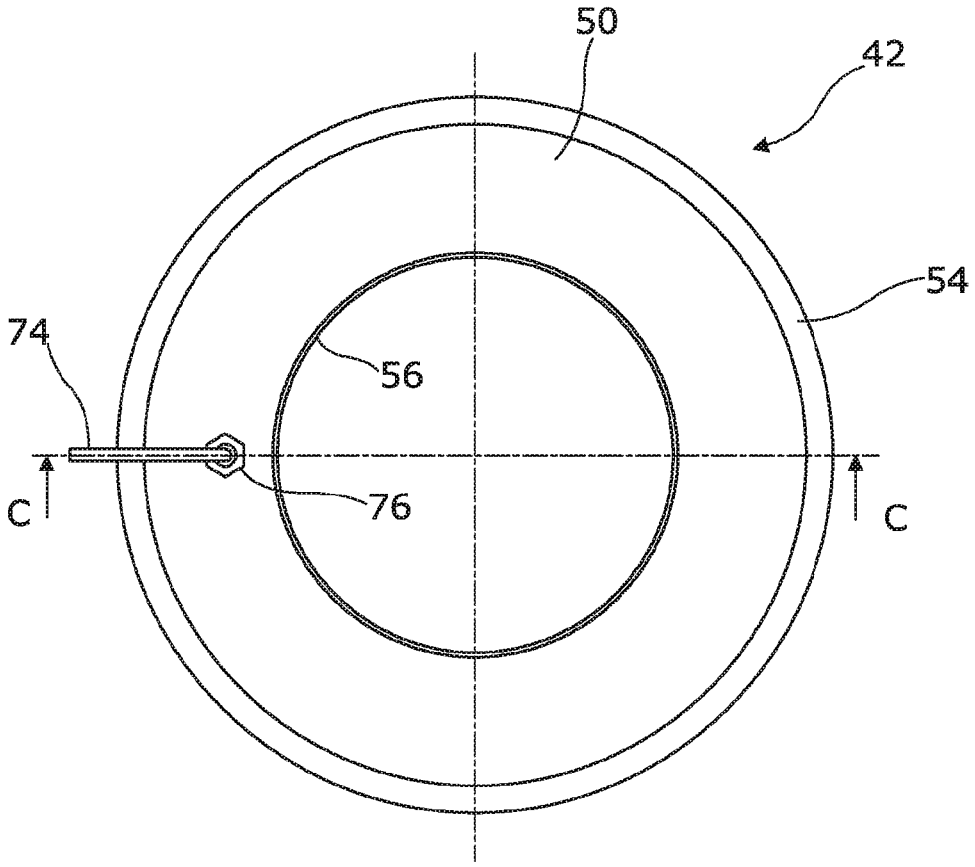
FIG. 7 is a plan view showing an upper side of the transition plate.
Figure 8:
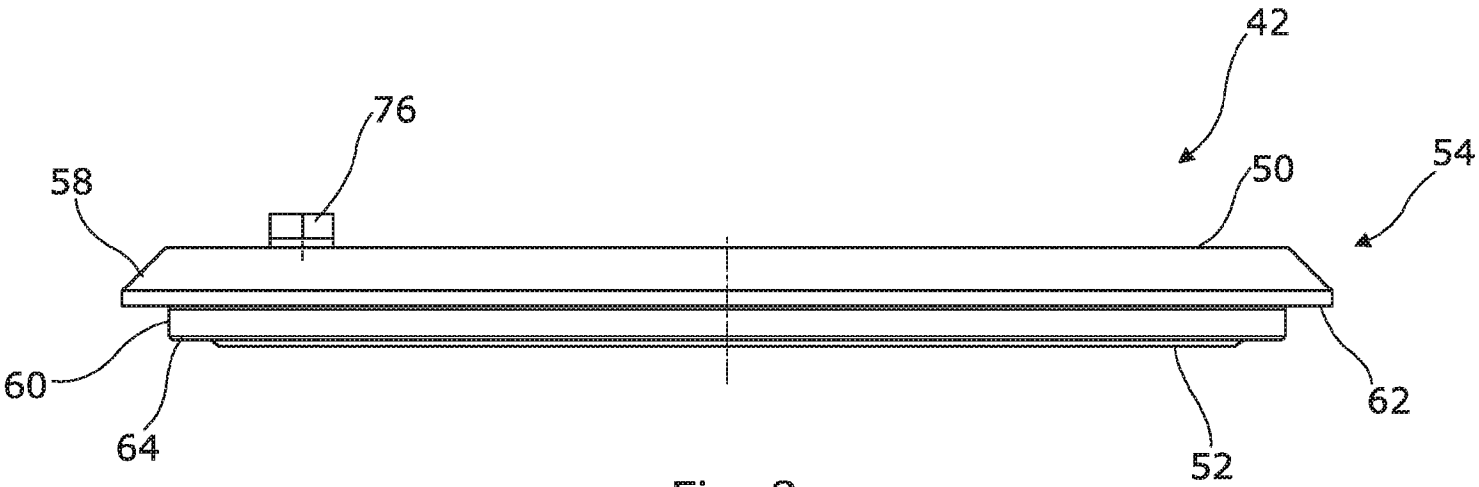
FIG. 8 is a side view of the transition plate.

As shown in FIG. 5, the transition plate 42 is located beneath the support table 4 with the inner perimeter 56 located around the lower end of the thimble 40. The outer perimeter 54 is positioned above and in contact with the upper end of the graphite casting ring 44, which engages the step 62 in the bottom face 52 of the transition plate 42.

During use in a DC casting operation, liquid metal flows from the distributor device 8 through the thimble 40 into the mould (or casting ring) 44. The transition plate 42 guides the flow of molten metal outwards from the thimble 40 to the casting ring 44, preventing oxidation of the metal and protecting the metal from contaminants. An inert gas, for example nitrogen or argon, is supplied under pressure to the chamber 70 in the transition plate 42, and flows through the permeable, porous material of the body 48 to the lower face 52. The gas escapes through the lower face 52, forming a thin layer of gas between liquid metal and the lower face 52 of the transition plate 42.

The gas layer prevents contact between the liquid metal and the transition plate 42, thus preventing erosion of the transition plate 42. In addition, the gas layer reduces friction between the liquid metal and the transition plate 42, thereby ensuring that the metal flows smoothly outwards from the thimble 40 to the casting ring 44. The layer of inert gas also prevents the metal from coming into contact with the air, thus preventing or at least reducing oxidation of the metal.

The transition plate 42 is constructed to provide a required level of permeability to enable a stable layer of gas to be formed between the lower face 52 of the transition plate 42 and the liquid metal. The transition plate 42 may be made from a number of different materials, including ceramic refractory materials that are based on fused silica, calcium silicate or graphite.

In one preferred form of the invention, the transition plate 42 is made from a ceramic refractory material that is based on fused silica, which is a fully dense amorphous or non-crystalline form of silicon dioxide $SiO_2$.

The refractory composition may also include microsilica, also called silica fume, which is an amorphous spherical form of silicon dioxide $SiO_2$, comprising an ultrafine powder consisting of particles in the range 1-3.5 μm.

The refractory composition may also include a bonding agent, for example comprising colloidal silica (a suspension of amorphous silica particles in water, with particle sizes typically in the range 3 to 100 nm). Alternatively, a cement may be used, for example Secar® 71 or Almatis® CA14M.

The refractory composition may also include a soluble ceramic fibre material: this type of material is also sometimes referred to as a "non-RCF" material. The soluble ceramic fibre material may for example be an alkaline earth silicate wool, which has high temperature stability up to 1200 C, low thermal conductivity and excellent wet forming characteristics. It is soluble (non-durable) in physiological fluids, for example lung fluid. This helps to reduce or avoid the health risks associated with the use of non-soluble fibres, which can cause lung disease if inhaled. Alternatively, a non-soluble refractory ceramic fibre (RCF) may be used, for example an alumino silicate wool fibre.

The refractory composition may also include a dispersing agent, for example a polyacrylate dispersing agent. The refractory composition may also include a rheology modifier, for example one based on calcined alumina.

A method of manufacturing a transition plate for use in a DC casting system will now be described. According to a first manufacturing method, the above materials are mixed and the refractory mixture is then introduced into a mould. The mould contains a sacrificial piece, for example a plastic ring, which forms the shape required for the chamber 70. The sacrificial piece is supported within the mould at the required position. The mould is vibrated as the refractory mixture is introduced to help the mixture flow easily throughout the mould.

Once the refractory material has set, the moulded part is removed from the mould and placed in a drying oven set at a temperature between 40 C and 140 C, according to the design and mass of the part. After drying, the moulded part is fired in a kiln, typically at a temperature in the range 700 C to 1550 C. During firing, the sacrificial piece embedded within the moulded part burns away leaving a cavity within the ceramic body, which forms the chamber 70 of the transition plate.

The removal of water from the moulded part during drying and during firing leaves a porous ceramic body, which is gas permeable and thus allows gas to travel from the chamber 70 to the lower face 52 of the transition plate 42. The formulation of the ceramic composition, including for example the water content of the colloidal silica, can be adjusted to provide the required degree of porosity.

The porosity can be measured for example by water absorption, according to standard test method ASTM C20-00(2015). We have found that good results can be obtained using a porosity in the range 0.5% to 55%, preferably 2-55%, and more preferably 10-55%.

We have found that good results can be obtained during casting if the inert gas fed into the chamber is supplied at a gauge pressure in the range 0.1-2.0 bar, preferably 0.2-1.0 bar, and/or at a flow rate in the range 5-30 litres/minute, preferably 10-20 litres/minute. This has been found to provide a stable gas layer between the liquid metal and the lower face of the transition plate, thus protecting the transition plate from chemical attack by the liquid metal and vapour.

Optionally, if required, the cast product can be machined to the required shape/dimensions. Typically machining is carried out on a CNC lathe so each part produced has repeatable accuracy. The cast product machines very well and to a very high accuracy, particularly if the fused silica has a small particle size (e.g. 200 mesh and smaller).

Alternative manufacturing methods are also possible. For example, instead of moulding the transition plate as a single part and using a sacrificial piece to create the chamber, the transition plate may be manufactured in two or more parts, which are then joined together, for example using fasteners or a suitable adhesive, leaving a chamber between the parts. It may also be possible to manufacture the transition plate using a 3D printing technique.

Initial tests suggest that gas permeable transition plates made from the refractory material described above and provided with a protective gas layer and a coating of boron nitride may be capable of producing in excess of 800 casts without failing, owing to the protection provided by the gas layer between the lower face of the plate and the liquid metal. A similar performance may also be obtainable even without a protective coating. By comparison, in a conventional casting process where a protective gas layer is not provided, transition plates made from a conventional calcium silicate refractory material will generally only operate for about 250 casts, and have to be coated at frequent intervals with a protective layer of boron nitride.

The transition plate may have various alternative structures to that described above. For example, the plate may include a plurality of separate chambers within the body of the transition plate.

Alternatively, instead of providing a chamber within the body of the transition plate, gas may be supplied to a compartment located above the upper face of the transition plate (i.e. between the transition plate and the casting table, so that gas permeates in use through the permeable refractory material of the transition plate from the upper face to the lower face.

In another embodiment, the transition plate may consist of a gas permeable lower part and a non-permeable upper part, which are separated by a gasket to provide a chamber between the upper and lower parts into which gas can be supplied.

In yet another embodiment, the transition plate may consist of a gas permeable lower part, a non-permeable upper part, and a more highly gas permeable middle part between the upper and lower parts into which gas can be supplied.

Various other forms of the transition plate are also possible. More generally, in an embodiment, at least a lower part of the transition plate body adjacent the lower face comprises a gas permeable refractory material, so that gas can pass through the gas permeable refractory material and escape from the transition plate through at least the lower face.

The invention claimed is:

1. A transition plate for use in a direct chill (DC) casting system, the transition plate comprising a substantially annular body having an upper face and a lower face, wherein the transition plate is configured to guide a flow of liquid metal outwards over the lower face during a casting operation, wherein at least a lower part of the body adjacent the lower face comprises a gas permeable refractory material, whereby gas can pass through the gas permeable refractory material and escape from the transition plate through the lower face to form a gas layer between the liquid metal and the lower face of the transition plate.

2. A transition plate according to claim 1, wherein the gas permeable refractory material is porous.

3. A transition plate according to claim 2, wherein the gas permeable refractory material has a porosity in the range 0.5% to 55%.

4. A transition plate according to claim 3, wherein the gas permeable refractory material has a porosity in the range 2-55%.

5. A transition plate according to claim 1, wherein the gas permeable refractory material has a density in the range 0.5-2.0 g/cm$^3$.

6. A transition plate according to claim 1, wherein at least a lower part of the body is made of a refractory ceramic material.

7. A transition plate according to claim 6, wherein at least a lower part of the body is made of a castable ceramic material that includes fused silica, ceramic fibre, microsilica and a bonding material.

8. A transition plate according to claim 1, wherein the transition plate comprises at least one chamber located within the body between the upper face and the lower face, and at least one gas duct connected to the chamber.

9. A transition plate according to claim 8, wherein at least a lower part of the body, located between the chamber and the lower face, comprises a gas permeable refractory material.

10. A transition plate according to claim 8, wherein the chamber is located closer to the lower face than the upper face.

11. A transition plate according to claim 8, wherein the chamber is located 1-5 mm from the lower face.

12. A transition plate according to claim 8, wherein the chamber extends around substantially the entire circumference of the annular body.

13. A transition plate according to claim 8, wherein the chamber is substantially annular.

14. A transition plate according to claim 8, wherein the chamber extends radially over the majority of the radial width of the lower face.

15. A direct chill (DC) casting system, comprising a distribution device, a thimble, a transition plate that extends radially outwards from a lower end of the thimble, and a casting ring that extends downwards from an outer periphery of the transition plate, wherein the transition plate comprises a substantially annular body having an upper face and a lower face, wherein the transition plate is configured to guide a flow of liquid metal outwards over the lower face during a casting operation, and wherein at least a lower part of the body adjacent the lower face comprises a gas permeable refractory material, whereby gas can pass through the gas permeable refractory material and escape from the transition plate through least the lower face to form a gas layer between the liquid metal and the lower face of the transition plate.

16. A direct chill (DC) casting system according to claim 15, further comprising a gas supply connected to the transition plate, whereby the supplied gas can pass through the gas permeable refractory material and escape from the transition plate through at least the lower face.

17. A direct chill (DC) casting system according to claim 16, wherein the transition plate comprises at least one chamber located within the body between the upper face and a lower face, and at least one gas duct connected to the chamber, wherein the gas supply is connected to the gas duct.

18. A method of operating a DC casting system comprising a distribution device, a thimble, a transition plate and a casting ring, wherein the transition plate comprises a substantially annular body having an upper face and a lower face, and wherein at least a lower part of the body adjacent the lower face is made of a gas permeable refractory material, the method comprising supplying liquid metal to the distribution device so that the liquid metal flows through the thimble and then flows outwards over the lower face of the transition plate towards the casting ring, and feeding gas to the transition plate so that the gas passes through the gas permeable refractory material and escapes from the transition plate through the lower face to form a gas layer between the liquid metal and the lower face of the transition plate.

19. A method according to claim 18, wherein the gas is an inert gas.

20. A method according to claim 18, wherein the gas is fed to the transition plate at a gauge pressure in the range 0.1-2.0 bar.

21. A method according to claim 18, wherein the gas is fed to the transition plate at a flow rate in the range 5-30 litres/minute.

* * * * *